US008648778B2

(12) United States Patent
Hong et al.

(10) Patent No.: US 8,648,778 B2
(45) Date of Patent: Feb. 11, 2014

(54) LIQUID CRYSTAL DISPLAY AND DRIVING METHOD THEREOF

(75) Inventors: Jincheol Hong, Kyungbuk (KR); Sungjo Koo, Daegu (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 969 days.

(21) Appl. No.: 12/292,693

(22) Filed: Nov. 24, 2008

(65) Prior Publication Data

US 2009/0146934 A1 Jun. 11, 2009

(30) Foreign Application Priority Data

Dec. 10, 2007 (KR) ..... 10-2007-0127758

(51) Int. Cl.
*G09G 3/36* (2006.01)

(52) U.S. Cl.
USPC ..... 345/87

(58) Field of Classification Search
USPC ..... 345/87, 95, 99–100
See application file for complete search history.

(56) References Cited

U.S. PATENT DOCUMENTS

| | | | | |
|---|---|---|---|---|
| 7,362,296 | B2 * | 4/2008 | Song et al. | 345/89 |
| 7,408,540 | B1 * | 8/2008 | Fullman et al. | 345/204 |
| 7,663,594 | B2 * | 2/2010 | Do et al. | 345/100 |
| 7,782,289 | B2 * | 8/2010 | Shen et al. | 345/99 |
| 7,821,484 | B2 * | 10/2010 | Choi | 345/98 |
| 7,843,474 | B2 * | 11/2010 | Lee et al. | 345/690 |
| 7,924,258 | B2 * | 4/2011 | O et al. | 345/100 |
| 2004/0170050 | A1 * | 9/2004 | Itoh et al. | 365/149 |
| 2006/0262069 | A1 * | 11/2006 | Do et al. | 345/98 |
| 2007/0046587 | A1 * | 3/2007 | Takahara | 345/76 |
| 2007/0085812 | A1 * | 4/2007 | O. et al. | 345/100 |
| 2007/0132709 | A1 * | 6/2007 | Kawaguchi | 345/102 |
| 2007/0139356 | A1 * | 6/2007 | Lee et al. | 345/103 |

* cited by examiner

*Primary Examiner* — William Boddie
*Assistant Examiner* — Towfiq Elahi
(74) *Attorney, Agent, or Firm* — Morgan, Lewis & Bockius LLP

(57) ABSTRACT

A liquid crystal display and driving method thereof are disclosed. The liquid crystal display according to an embodiment of the invention includes a liquid crystal panel having liquid crystal cells in a matrix array at crossings of data lines and gate lines; a timing controller for receiving a digital video data and synchronous signals, and generating a source output enable signal, a first gate start pulse, a second gate start pulse having a pulse width different from that of the first gate start pulse, a gate shift clock, a first gate output enable signal and a second gate output enable signal; a data driving circuit for providing a data voltage to the data lines in response to a first logic value of the source output enable signal, and any one black gray voltage of a charge share voltage and a precharge voltage to the data lines in response to a second logic value of the source output enable signal; and a gate driving circuit for providing a first gate pulse in synchronization with the data voltage and a second gate pulse in synchronization with the black gray voltage to the gate lines, in response to the first gate start pulse, the second gate start pulse, the gate shift clock, the first gate output enable signal and the second gate output enable signal.

20 Claims, 18 Drawing Sheets

LIQUID CRYSTAL DISPLAY AND DRIVING METHOD THEREOF

This nonprovisional application claims priority under 35 U.S.C. §119(a) on Patent Application No. 10-2007-0127758 filed in Republic of Korea on Dec. 10, 2007, which is hereby incorporated by reference in its entirety.

BACKGROUND OF THE INVENTION

1. Field of the Invention

Embodiments of the invention relate to a display device, and more particularly to, a liquid crystal display and driving method thereof. Although embodiments of the invention are suitable for a wide scope of applications, it is particularly suitable for liquid crystal displays that can be driven according to an impulse driving method.

2. Related Art of the Invention

An active matrix type liquid crystal display (LCD) displays video (or motion picture) by using thin film transistors (TFTs) as switching elements. The LCDs can be fabricated to be compact compared to the cathode ray tubes (CRTs), so the LCDs are being implemented in display devices of portable information devices, office machines, computers, televisions, and the like, rapidly replacing the CRTs.

The LCD has a blurring phenomenon in that a screen image of video is not clear but blurred due to hold properties of the liquid crystal material. In the CRT, phosphors are illuminated only during a very short time, as shown in FIG. 1 to display data on cells and an image is displayed by impulse driving without illumination at the cells. In comparison, in the LCD, as shown in FIG. 2, an image is displayed by a hold driving such that after data is supplied to liquid crystal cells during a scanning period, the data charged in the liquid crystal cells is maintained during the remaining field period (or frame period).

Video (or motion picture) is displayed on the CRT according to the impulse driving, so perceived image that may be viewed by a viewer (observer) is vivid, as shown in FIG. 3. Comparatively, in the LCD, because of the hold properties of liquid crystal material, the contrast of a perceived image that may be seen by the viewer is not clear but dim and blurred. The difference between the perceived images results from the integration effect of an image that temporarily continues in the eyes that follow the movement. Thus, although the response speed of the LCD is fast, the viewer is bound to see the blurred screen image due to the discrepancy between the eyes' movement and a static image of each frame. To avoid such a motion blurring phenomenon in the LCD, a technique for driving the LCD according to the impulse driving method, such as a black data insertion (BDI) method, has been proposed in which after video data is displayed on the screen, black data is provided to the screen.

The black data insertion method is video data being sequentially displayed on the 'j' number of lines ('j' is a positive integer) in some blocks of the screen, and black data is simultaneously displayed on the 'k' number of lines ('k' is a positive integer) in other blocks of the screen. Thus, in the black data insertion method, the frequency of data should be fast when the data is displayed on the liquid crystal panel, compared with the frequency of data inputted from the exterior. For this purpose, the frequency (Fi) of a timing signal such as a dot clock inputted from the exterior together with data should be multiplied by $$f_0 = \frac{j+k}{j} \cdot fi$$

by using a phase locked loop (PLL) 51 as shown in FIG. 5. A line memory 52 temporarily stores digital video data and then supplies the digital video data to a data driving circuit according to a dot clock having the frequency which has been multiplied by the PLL 51. The PLL 51 and the line memory 52 are positioned in a timing controller to convert a transmission frequency of data because the frequency of the digital video data inputted to the data driving circuit is faster than that of the digital video data inputted to the timing controller. Thus, the related art black data insertion method increases the costs of the timing controller because of the frequency multiplication operation of the PLL 51 and heats up the timing controller. In addition, in the related art black data insertion method, because the operation frequency of the data driving circuit is increased, the heating of the data driving circuit is increased, and also because the transmission frequency of the digital video data is increased between the timing controller and the data driving circuit, EMI (ElectroMagnetic Interference) is also increased.

In an LCD employing such a black data insertion method, the degradation of the charging characteristics of the video data and the black data deteriorates gray scale representation of data and the impulse driving effect. The inventors of the embodiments of the invention conducted experimentation on the LCD such that video data were sequentially displayed on four (j=4) data lines of particular blocks, black data were sequentially displayed, one (k=1) data line (k=1) at a time, at other blocks, and then white gray voltage and black gray voltage were applied to liquid crystal cells of the liquid crystal panel with high driving frequency by multiplying the frequency of dot clock by 5/4*fi. In addition, with the same LCD which, however, did not employ the black data insertion method, the inventors of the embodiments of the invention applied the white gray voltage and the black gray voltage to obtain certain gray scale representation capabilities and data charging characteristics and compared them with those of the LCD employing the black data insertion method. According to the experimentation results as shown in FIG. 6, the normally-driven LCD without employing the black data insertion method had the voltage of liquid crystal cells measured by 4.95V to 50 mV when the data gray scales were changed from the white gray voltage of 255 gray scales to the black gray voltage of 0 gray scale. In comparison, in the LCD employing the black data insertion method, when the white gray voltage of the 255 gray scales was changed to the black gray voltage of 0 gray scale by making the driving frequency fast, the voltage of the liquid crystal cells was measured by 4.95V to 1.04 mV. Thus, in the LCD employing the black data insertion method, when the gray scales of data change from the white gray level to the black gray level, because the black gray voltage is not sufficiently low, the black gray level cannot be properly represented. Also, although there may be a difference to some degree, in the LCD employing the black data insertion method, when data applied to the liquid crystal display panel changes from each gray level to the black gray level, the voltage corresponding to the black gray level is too high to ideally change the data of the black gray level.

SUMMARY OF THE INVENTION

Accordingly, embodiments of the invention are directed to a liquid crystal display and driving method thereof that substantially obviates one or more of the problems due to limitations and disadvantages of the related art.

An object of embodiments of the invention is to provide a liquid crystal display (LCD) and its method capable of obtaining an impulse driving effect and reduce the heating of circuits and costs without increasing a driving frequency.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the liquid crystal display according to an embodiment of the invention includes a liquid crystal panel having liquid crystal cells in a matrix array at crossings of data lines and gate lines; a timing controller for receiving a digital video data and synchronous signals, and generating a source output enable signal, a first gate start pulse, a second gate start pulse having a pulse width different from that of the first gate start pulse, a gate shift clock, a first gate output enable signal and a second gate output enable signal; a data driving circuit for providing a data voltage to the data lines in response to a first logic value of the source output enable signal, and any one black gray voltage of a charge share voltage and a precharge voltage to the data lines in response to a second logic value of the source output enable signal; and a gate driving circuit for providing a first gate pulse in synchronization with the data voltage and a second gate pulse in synchronization with the black gray voltage to the gate lines, in response to the first gate start pulse, the second gate start pulse, the gate shift clock, the first gate output enable signal and the second gate output enable signal. In another aspect, the method of driving a liquid crystal display according to an embodiment of the invention comprises generating a source output enable signal, a first gate start pulse, a second gate start pulse having a pulse width different from that of the first gate start pulse, a gate shift clock, a first gate output enable signal and a second gate output enable signal; providing a data voltage to the data lines by supplying a first logic value of the source output enable signal to data driving circuit, and any one black gray voltage of a charge share voltage and a precharge voltage to the data lines by supplying a second logic value of the source output enable signal to the data driving circuit; and providing a first gate pulse in synchronization with the data voltage to the gate lines, and a second gate pulse in synchronization with the black gray voltage to the gate lines by supplying the first gate start pulse, the second gate start pulse, the gate shift clock, the first gate output enable signal and the second gate output enable signal to the gate driving circuit.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
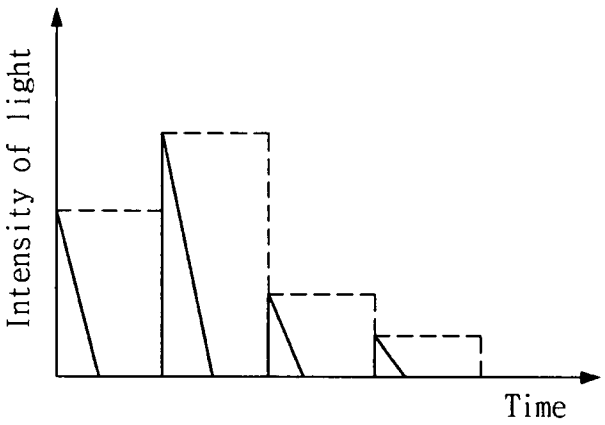
Fig. 1 [Related Art]
FIG. 1 is a graph showing the illumination characteristics of a CRT.
Figure 2:
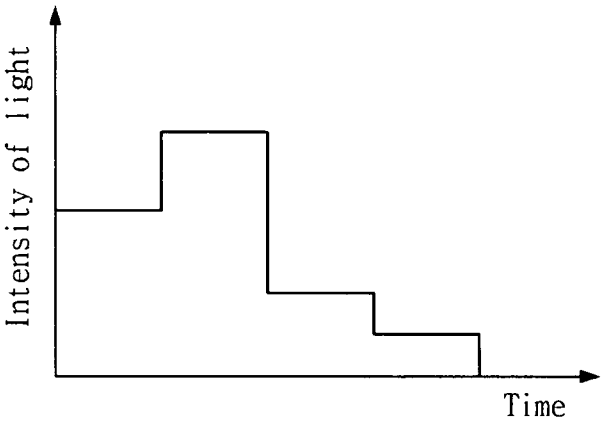
Fig. 2 [Related Art]
FIG. 2 is a graph showing the illumination characteristics of a liquid crystal display (LCD).
Figure 3:
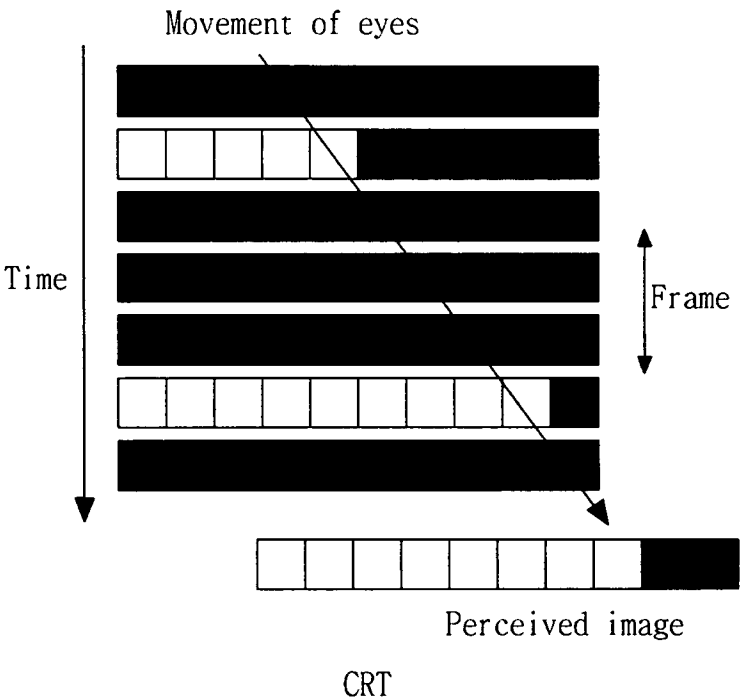
Fig. 3 [Related Art]
FIG. 3 is a view illustrating a perceived image felt by a viewer with respect to the CRT.
Figure 4:
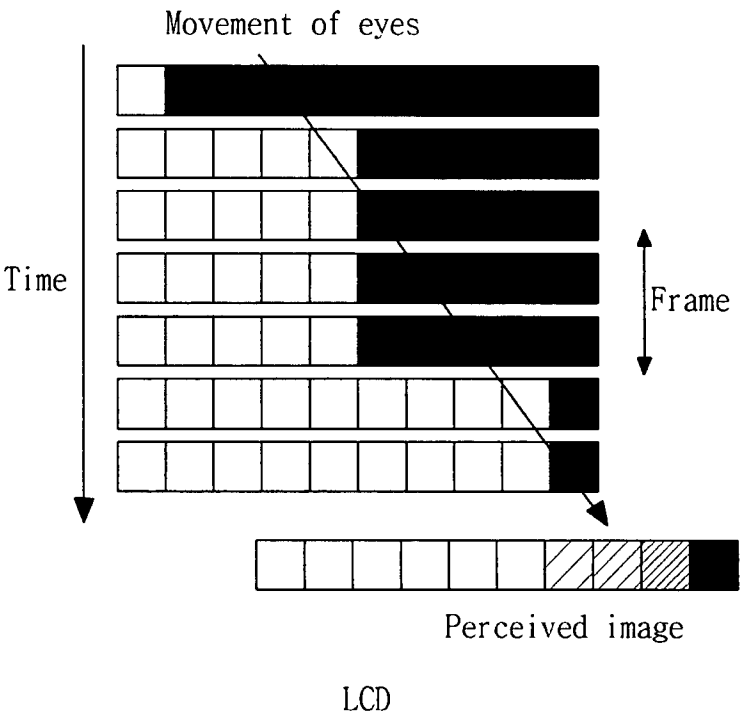
Fig. 4 [Related Art]
FIG. 4 is a view showing a perceived image felt by a viewer with respect to the LCD.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

In the drawings, the thicknesses of layers and regions are exaggerated for clarity. Like reference numerals in the drawings denote like elements.

Figure 7:
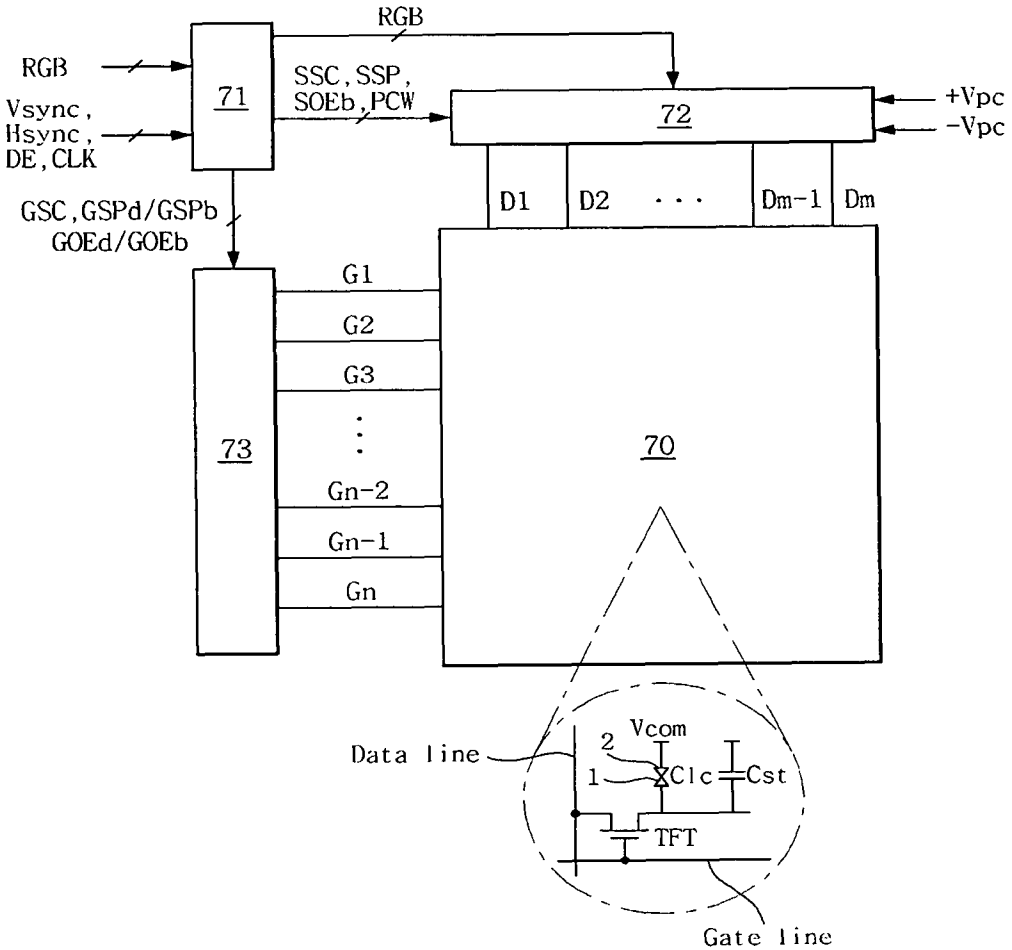
FIG. 7 is a block diagram showing an LCD according to an exemplary embodiment of the invention.

With reference to FIG. 7, an LCD according to an exemplary embodiment of the invention includes a liquid crystal panel 70, a timing controller 71, a data driving circuit 72, and a gate driving circuit 73. The data driving circuit 72 includes a plurality of source drive ICs (Integrated Circuits). The gate driving circuit 73 includes a plurality of gate drive ICs.

In the liquid crystal panel 70, a layer of liquid crystal material is positioned between two glass substrates. The liquid crystal panel 70 includes the m x n number of liquid crystal cells Clc disposed in a matrix array at each crossing of the 'm' number of data lines D1 to Dm with the 'n' number of gate lines G1 to Gn.

On the lower, glass substrate of the liquid crystal panel 70, data lines D1 to Dm, gate lines G1 to Gn, thin film transistors (TFTs), liquid crystal cells Clc, storage capacitors Cst, and the like are formed, which are connected with the TFTs. Black matrixes, color filters, and common electrodes 2 are formed on an upper glass substrate of the liquid crystal panel 70. The liquid crystal material in the liquid crystal cells Clc is driven by electric fields between pixel electrodes 1 and common electrodes 2. The common electrodes 2 are formed on the upper glass substrate in a vertical field driving method, such as a TN (Twisted Nematic) mode and a VA (Vertical Alignment) mode, and formed on the lower glass substrate together with the pixel electrodes 1 in an in-plane field driving method, such as an IPS (In-Plane Switching) mode and an FFS (Fringe Field Switching) mode. Polarizers having perpendicular optical axes are attached on the upper and lower glass substrates of the liquid crystal panel 70, and an alignment film is formed at least on the lower glass substrate to set a pre-tilt angle for the liquid crystal material.

Figure 5:
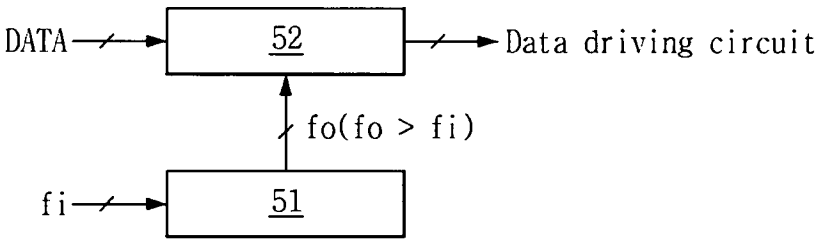
Fig. 5 [Related Art]
FIG. 5 is a block diagram showing a frequency multiplication circuit according to the related art data insertion method.
Figure 6:
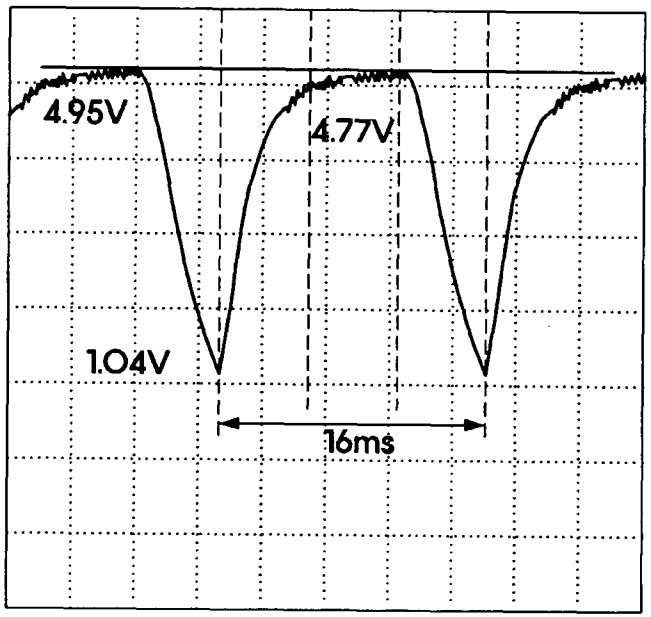
Fig. 6 [Related Art]
FIG. 6 is a graph showing the charge characteristics of white/black data voltages of the LCD employing the related art black data insertion method.

The timing controller 71 receives video data RGB and timing signals, such as vertical/horizontal synchronous signals Vsync and Hsync, a data enable signal DE, a dot clock signal CLK, etc., and generates control signals for controlling operation timing of the data driving circuit 72 and the gate driving circuit 73. The control signals include a gate timing control signal and a data timing control signal. In addition, the timing controller 71 transmits a transmission frequency of digital video data RGB inputted from an external system board, without multiplying it, to the data driving circuit 72. Thus, the timing controller 71 does not need such circuits, as shown in FIG. 5, to make the transmission frequency of the digital video data RGB to be transmitted to the data driving circuit 72 faster than the input data frequency.

The gate timing control signal includes a BDI gate timing control signal that generates an impulse driving effect and a normal driving gate timing control signal without increasing the transmission frequency of the digital video data RGB to be transmitted to the data driving circuit 72. Either the BDI gate timing control signal or the normal driving gate timing control signal may be determined according to selection of a voltage level applied to an option pin of the timing controller before a product is placed out on the market, or may be selected according to analysis results of input data during normal driving.

The BDI gate timing control signal is divided into a first BDI gate timing control signal for controlling operation timing of the gate drive ICs to provide video data in synchronization with first BDI gate timing pulses, and a second BDI gate timing control signal for controlling operation timing of the gate drive ICs to provide charge share voltage in synchronization with second BDI gate timing pulses. The first and second BDI gate timing control signals are alternately applied to the respective gate drive ICs in an impulse driving mode in which a data voltage and a black gray voltage are alternately applied to the liquid crystal panel 70. If the liquid crystal panel 70 is driven according to the normal driving method, not the impulse driving method, the respective gate drive ICs are controlled by the normal driving gate timing control signal.

The first BDI gate timing control signal includes a first gate start pulse GSPd, a gate shift clock GSC, a first gate output enable signal GOEd, and the like. The first gate start pulse GSPd indicates a line from which scanning starts to generate a first gate pulse from a gate drive IC that handles some blocks (referred to as 'data display blocks', hereinafter) of a screen on which the video data is displayed. The first gate start pulse GSPd has a short pulse width, e.g., a pulse width by one horizontal period. The first gate output enable signal GOEd indicates a time period during which gate pulses are generated by the gate drive IC that handles the data display blocks. The gate drive IC outputs the gate pulses during a low logical period between pulses of the first gate output enable signal GOEd and cuts off outputting of the gate pulses during a high logical period, namely, a pulse width period, of the first gate output enable signal GOEd. Here, the high logical period refers to a duty-on-time from a rising time to a falling time of a pulse, and the low logical period refers to a duty-off-time from the falling time of the pulse to a rising time of a subsequent pulse.

The second BDI gate timing control signal includes a second gate start pulse GSPb, the gate shift clock GSC, and a second gate output enable signal GOEb, etc.

The second gate start pulse GSPb is applied to a gate drive IC that handles some blocks (referred to as 'black display blocks', hereinafter) of the screen which are displayed to be black by a black gray voltage, and indicates a line from which scanning starts to generate a first gate pulse at the black display blocks. The second gate start pulse GSPb is generated with a pulse width larger than that of the first gate start pulse GSPd, e.g., a pulse width by an 'N' (N is an integer of 2 or greater) horizontal period NH, so that scan time of lines to which the black gray voltage is supplied can overlap. The second gate output enable signal GOEb indicates a time period during which gate pulses are generated by the gate drive IC that handles the black display block. The gate drive IC that handles the black display blocks outputs gate pulses during a low logical period between pulses of the second gate output enable signal GOEb.

The second gate output enable signal GOEb has a reversed phase. This is to allow the liquid crystal cells of the data display blocks to charge only the data voltage, and the liquid crystal cells of the black display blocks to charge only the charge share voltage. The gate drive IC handling the data display blocks outputs gate pulses in synchronization with the video data voltage in response to the first gate output enable signal GOEd. Meanwhile, the gate drive IC handling the black display blocks outputs gate pulses in synchronization with the black gray voltage in response to the second gate output enable signal GOEb. The gate shift clock GSC is commonly supplied to the gate drive IC handling the data display blocks and the gate drive IC handling the black display blocks. The gate shift clock GSC is a timing control signal for controlling the gate drive ICs to sequentially shift the gate start pulses GSPd and GSPb.

The first and second gate output enable signals GOEd and GOEb have a higher logical period and shorter low logical period than the gate output enable signal used in the related art LCD employing the black data insertion method or in the related art LCD that does not use the black data insertion method. That is, the duty ratios of the first and second gate output enable signals GOEd and GOEb are higher than that of the gate output enable signal of the related art. For example, the duty ratio of the first gate output enable signal GOEd is 40% to 60%, but that of the normal gate output enable signal is 10% or lower. In another example, the duty ratio of the second gate output enable signal GOEb is 40% to 60%, but that of the normal gate output enable signal is 10% or lower.

The normal driving gate timing control signal without the impulse driving effect includes the normal gate output enable signal having a small duty ratio, instead of the gate output enable signals GOEd and GOEb of the BDI gate timing control signal.

The data timing control signal includes a BDI data timing control signal that generates the impulse driving effect and a normal driving data timing control signal without such impulse driving effect. Either the BDI data timing control signal or the normal driving data timing control signal may be determined according to selection of a voltage level applied to an option pin of the timing controller before a product is placed out on the market, or may be selected according to analysis results of input data during normal driving. When the data voltage and the black gray voltage are applied to the liquid crystal panel 70 to display data according to the impulse method, the source drive ICs are controlled by the BDI data timing control signal, respectively, and when the liquid crystal panel 70 is driven according to the normal driving method, not the impulse driving method, the source drive ICs are controlled by the normal driving data timing control signal, respectively.

The BDI data timing control signal includes a source start pulse SSP, a source sampling clock SSC, a polarity control signal POL, a BDI source output enable signal SOEb, etc. The source start pulse SSP indicates a start pixel at a first horizontal line where data is to be displayed. The source sampling clock SSC indicates data latching operation within the data driving circuit 72 based on a rising or falling edge. The polarity control signal POL controls the polarity of an analog video data voltage outputted from the data driving circuit 72. The BDI source output enable signal SOEb controls an output time of the black gray voltage and the video data voltage outputted from the source drive ICs. The black gray voltage is outputted from the source drive ICs during a high logical period of the BDI source output enable signal SOEb, and the analog video data voltage is outputted from the source drive ICs during a low logical period of the BDI source output enable signal SOEb. The BDI source output enable signal SOEb has a longer high logical period, namely, the longer pulse width period, compared with a normal source output enable signal to increase the output time of the black gray voltage. For this purpose, preferably, the BDI source output enable signal SOEb has a duty ratio of 40% to 60%. If the duty ratio of the BDI source output enable signal SOEb is smaller than 40%, the charge time of the black gray voltage is shortened to reduce the black data insertion effect, namely, the impulse driving effect. If the duty ratio of the BDI source output enable signal SOEb exceeds 60%, the charge time of the analog data voltage would be excessively shortened to degrade gray scale representation of the data.

The normal driving data timing control signal without the impulse driving effect includes the normal source output enable signal having a duty ratio of 10% or lower, instead of the source output enable signal SOEb of the BDI data timing control signal. In addition, the timing controller 71 supplies a precharge control signal PCW to the data driving circuit 72. The data driving circuit 72 supplies positive polarity/negative polarity voltage +Vpc/−Vpc to the data lines D1 to Dm in response to the pulse of the precharge control signal PCW. The precharge control signal PCW has a duty ratio of 10% or lower in the normal driving mode without the impulse driving effect. Comparatively, however, in the embodiments of the invention, when the LCD is driven in the impulse driving mode, the duty ratio of the precharge control signal PCW is increased to 40% to 60% to lengthen the charge time of the positive polarity/negative polarity voltage +Vpc/−Vpc to provide the impulse effect. If the duty ratio of the precharge control signal PCW is smaller than 40%, a sufficient impulse driving effect couldn't be obtained, and if the duty ratio of the precharge control signal PCW exceeds 60%, the charge time of the video data voltage would be shortened to possibly degrade the gray scale representation of the video data.

The black gray voltage is not generated as digital video data of the black gray level by the timing controller 71 but is an analog voltage generated from each source drive IC of the data driving circuit 72.

A first example of the black gray voltage is the charge share voltage. The charge share voltage is an average voltage generated when a data line to which the positive polarity voltage is supplied and a data line to which the negative polarity data voltage is supplied are short-circuited, or a common voltage Vcom applied to the common electrodes 2 of the liquid crystal cell Clc. Thus, the charge share voltage has little difference from the common voltage Vcom or is an equi-potential voltage with the common voltage Vcom. The first example of the black gray voltage is applied to the liquid crystal panel 70 driven in a normally black mode. The normally black mode refers to a driving mode in which as the data voltage applied to the liquid crystal cells is increased, the luminance level, namely, the gray level, is increased. The charge share voltage reduces a voltage difference between the pixel electrode 1 and the common electrode 2 of the liquid crystal cell Clc in the liquid crystal panel 70 driven in the normally black mode, to thus display the black gray level at the liquid crystal cell Clc.

A second example of the black gray voltage is the positive polarity/negative polarity precharge voltage +Vpc/−Vpc. The positive polarity precharge voltage +Vpc is a maximum positive polarity data voltage or a positive polarity voltage between the maximum positive polarity data voltage and the charge share voltage. The positive polarity precharge voltage +Vpc is supplied to the data lines D1 to Dm before the positive polarity data voltage to reduce a swing width of the positive polarity data voltage and thus reduce current flowing across the source drive ICs. The maximum positive polarity data voltage and the maximum data polarity data voltage have to sufficiently substantial so as to make a black gray level. The negative precharge voltage −Vpc is a maximum negative polarity data voltage or a negative polarity voltage between the maximum negative polarity data voltage and the charge share voltage. The negative precharge voltage −Vpc is supplied to the data lines D1 to Dm before the negative polarity data voltage to reduce a swing width of the negative polarity data voltage and thus reduce current flowing across the source drive ICs. The second example of the black gray voltage is applied to the liquid crystal panel 70 driven in a normally white mode. The normally white mode refers to a driving mode in which as the data voltage applied to the liquid crystal cells is increased, the luminance level, namely, the gray level, is lowered. The positive polarity/negative polarity precharge voltage increases a voltage difference between the pixel electrode 1 and the common electrode 2 of the liquid crystal cell Clc in the liquid crystal panel 70 by the black gray voltage, to thus display the black gray level at the liquid crystal cell Clc.

The data driving circuit 72 latches the digital video data RGB under the control of the timing controller 71. The data driving circuit 72 supplies the black gray voltage generated as the charge share voltage or the positive polarity/negative polarity precharge voltage to the data lines D1 to Dm, converts the digital video data RGB into analog positive polarity/negative polarity gamma correction voltage according to the polarity control signal POL to generate a positive polarity/negative polarity analog data voltage, and then supplies the generated data voltage to the data lines D1 to Dm. In addition, the data driving circuit 72 supplies the positive polarity/negative polarity precharge voltage +Vpc/−Vpc to the data lines D1 to Dm.

Following the charge share voltage and the precharge voltage, the analog video data voltage may be supplied to the data lines D1 to Dm by the precharge control signal and the source output enable signal.

The gate drive ICs of the gate driving circuit 73 include a shift register, a level shifter that converts an output signal of the shift register to have a swing width suitable for driving the TFTs of the liquid crystal cells, and an output buffer connected between the level shifter and the gate lines G1 to Gn, respectively. The gate driving circuit 73 sequentially supplies gate pulses to the gate lines in response to the gate timing control signals.

Figure 8:
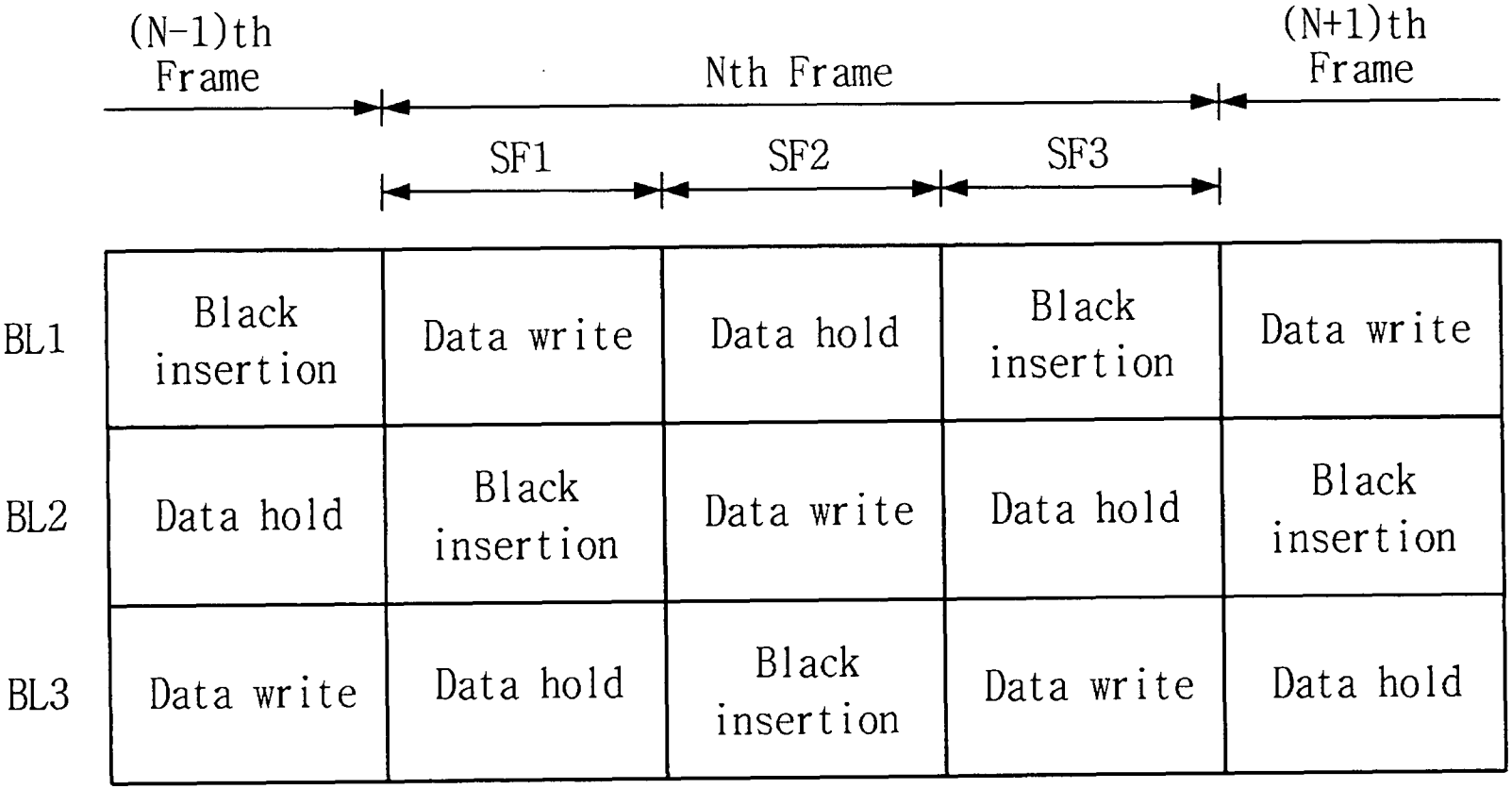
FIG. 8 is a view showing data writing, data holing and black insertion operation in each block when the LCD is driven according to an impulse driving method according to an exemplary embodiment of the invention.
Figure 9A:
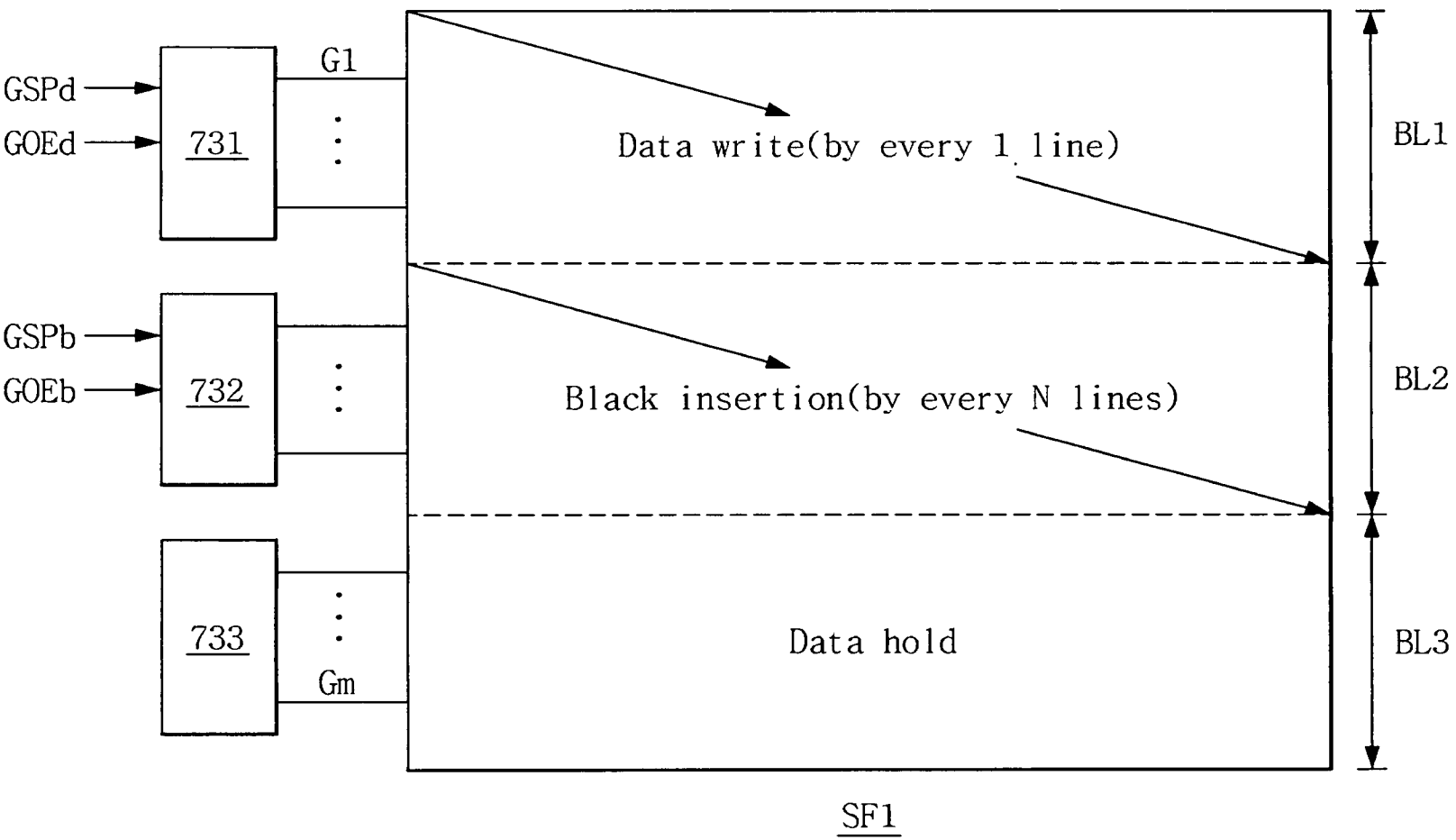
FIGS. 9*a* to 9*c* are views showing gate timing control signals applied to gate drive integrated circuits of each block according to sub-frames and a display state of a screen in the LCD according to an exemplary embodiment of the invention.
Figure 9B:
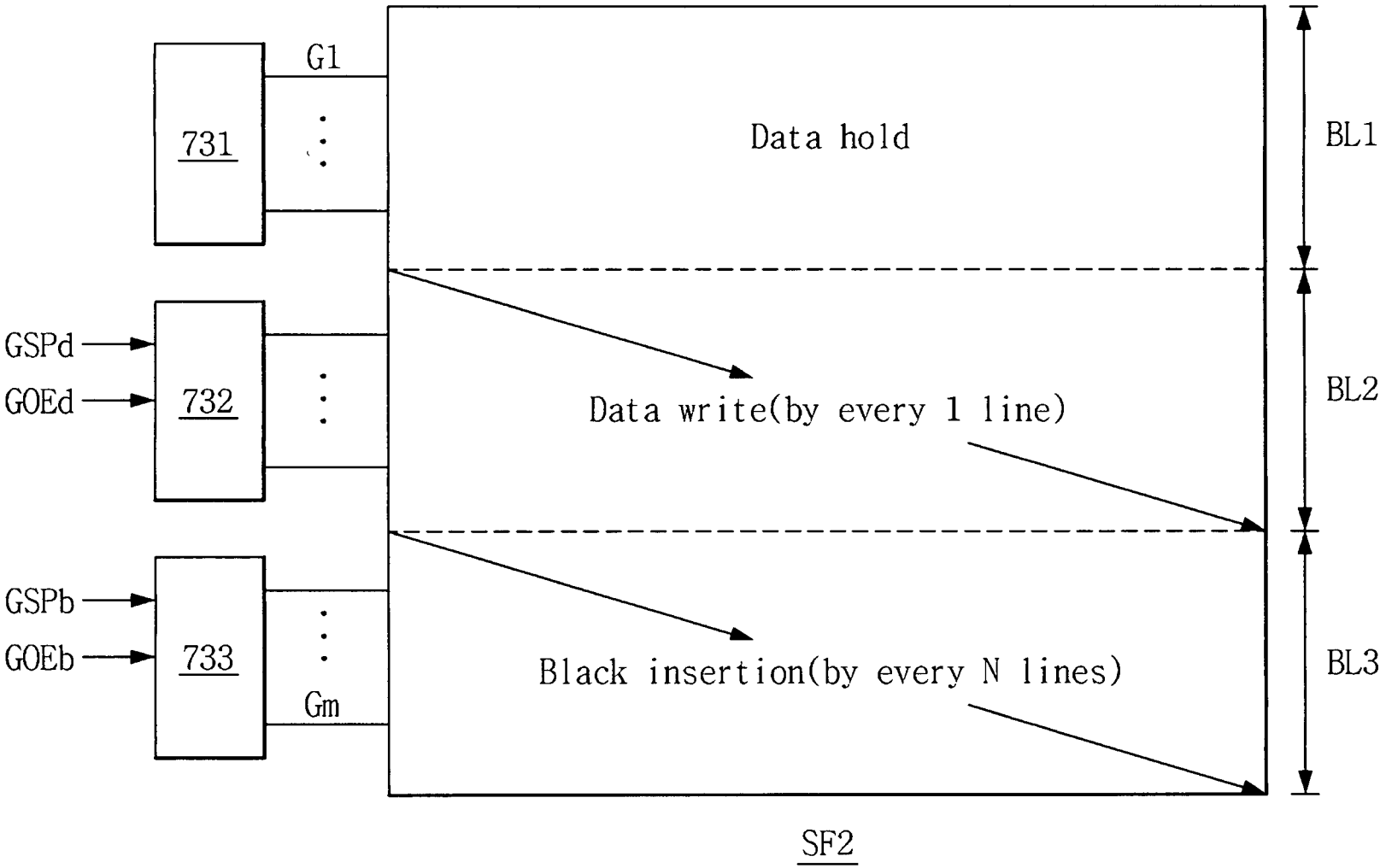
Figure 9C:
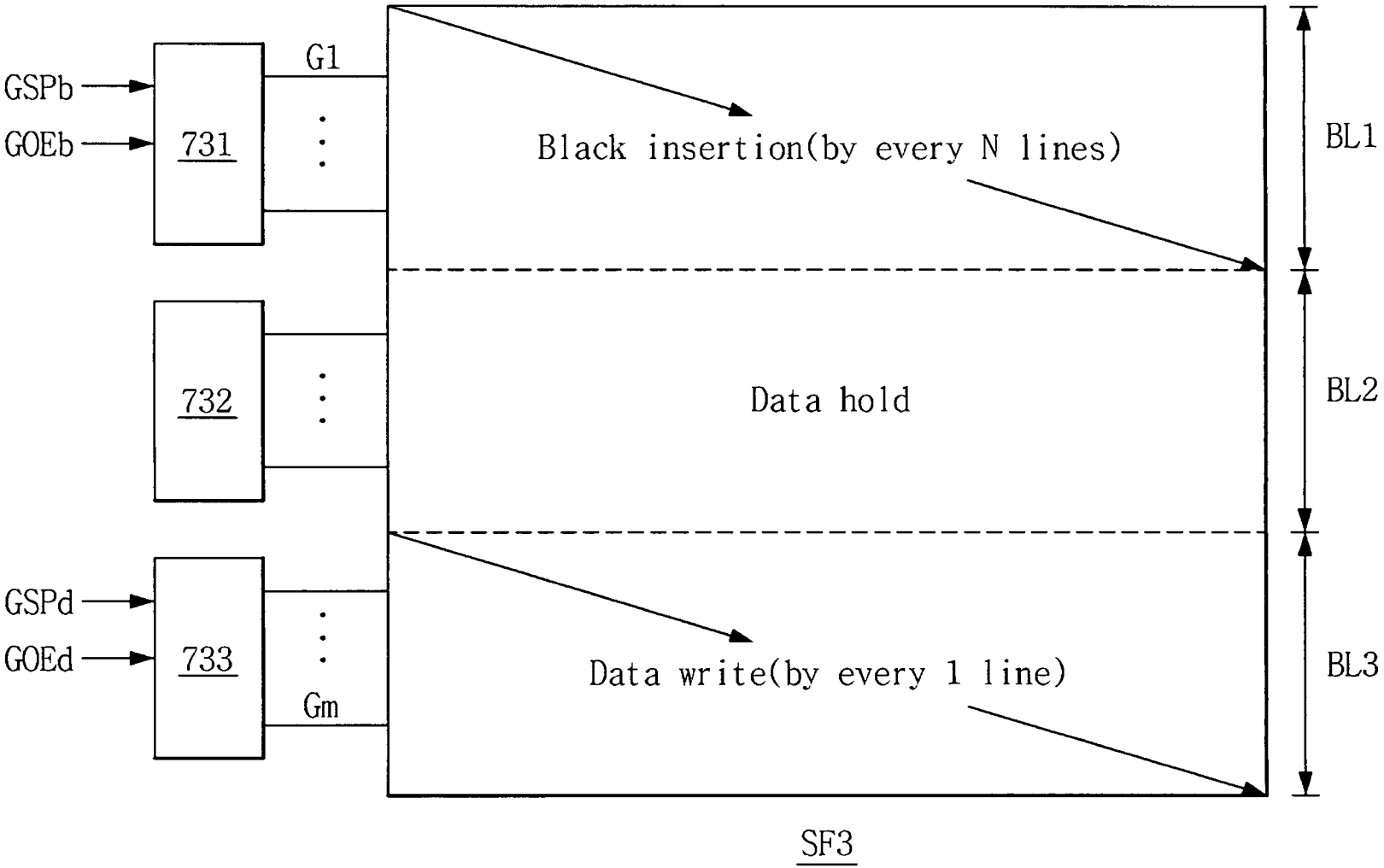

FIG. 8 is a view showing data writing, data holing and black insertion operation in each block when the LCD is driving according to the impulse driving method according to an exemplary embodiment of the invention. FIGS. 9*a* to 9*c* are views showing gate timing control signals applied to gate drive ICs of each block according to sub-frames and a display state of a screen in the LCD according to an exemplary embodiment of the invention. With reference to FIG. 8, in the LCD according to an exemplary embodiment of the invention, the display screen of the liquid crystal panel 70 is divided into a plurality of blocks, and the operations of data writing→data holding→black insertion are performed by blocks, and in this case, each block is independently controlled. In addition, in the LCD according to an exemplary embodiment of the invention, driving is performed by time division of one frame into sub-frames by the number of blocks. In the respective sub-frames (SF1 to SF3), one block is controlled as a data write block, another block is controlled as a data hold block, and still another block is controlled as a black insertion block.

On the assumption that the gate driving circuit 73 includes three gate drive ICs 731 to 733, the liquid crystal panel 70 is spatially divided into three blocks BL1 to BL3 to be driven, and one frame is time-divided into three sub-frames, the operations of the respective blocks BL1 to BL3 and the corresponding data and gate drive ICs will be described as follows.

During the first sub-frame period SF1, the first BDI gate timing control signal comprising the first gate start pulse GSPd, the first gate output enable signal GOEd, etc., as shown in FIG. 9*a* is applied to the first gate drive IC 731. Then, the first gate drive IC 731 sequentially supplies gate pulses having a pulse width by-substantially one horizontal period to the gate lines of the first block BL1 in response to the first gate start pulse GSPd and the first gate output enable signal GOEd. While the first block BL1 is being scanned, the source drive ICs alternately output the black gray voltage and the analog video data voltage in response to the BDI source output enable signal SOEb. At this time, the gate pulses sequentially supplied to the gate lines of the first block BL1 are synchronized with the analog video data voltage outputted from the source drive ICs according to the first gate output enable signal GOEd. Accordingly, the analog video data voltage is charged (written) one line at a time at the first block BL1 during the first sub-frame period SF1.

During the first sub-frame period SF1, the second BDI gate timing control signal comprising the second gate start pulse GSPb, the second gate output enable signal GOEb, etc., as shown in FIG. 9*a* is applied to the second gate drive IC 732. Then, the second gate drive IC 732 sequentially supplies gate pulses having a pulse width by substantially the N number of horizontal periods, e.g., by three horizontal periods, to the gate lines of the second block BL2 in response to the second gate start pulse GSPb and the second gate output enable signal GOEb. Here, the pulse width by the substantially the N number of horizontal periods refers to the sum of pulse widths of the N number of gate pulses which are intermittently generated by the second gate output enable signal GOEb and successively applied to the respective gate lines. Among the N number of gate pulses supplied to the Nth gate line in the second block BL2, the remaining (N−1) number of gate pulses excluding the first gate pulse overlap with the (N−1) number of gate pulses supplied to the (N+1)th gate line according to the correlation of the second gate start pulse GSPb, the gate shift clock GSC, and the second gate output enable signal GOEb. This will be described in detail with reference to FIGS. 10 and 11. While the second block BL2 is being scanned, the source drive ICs alternately output the black gray voltage and the analog video data voltage in response to the BDI data timing control signal. BDI data timing control signal includes the source output enable signal SOEb having a relatively large duty ratio. At this time, the gate pulses sequentially supplied to the gate lines of the second block BL2 are synchronized with the black gray voltage outputted from the source drive ICs according to the second gate output enable signal GOEb. Accordingly, during the first sub-frame period SF1, except for the (N−2) number of lines to which the gate pulses are first supplied, the N number of lines are simultaneously scanned at the second block BL2 to simultaneously charge the black gray voltage to the N number of lines. Thus, in embodiments of the invention, because the black gray voltage is simultaneously charged in the N number of lines at the block to which the black data is inserted, the charge time of the black gray voltage can be secured to thus stably represent the black gray level.

During the first sub-frame period SF1, the gate start pulse and the gate output enable signal are not applied to the third gate drive IC 733 as shown in FIG. 9*a*. Thus, during the first sub-frame period SF1, the liquid crystal cells of the third block BL3 maintain the analog data voltage that has been charged during a previous frame period.

During a second sub-frame period SF2, the gate start pulse and the gate output enable signal are not applied to the first gate drive IC 731 as shown in FIG. 9*b*. Thus, during the second sub-frame period SF2, the liquid crystal cells of the first block BL1 maintains the analog data voltage which has been charged during the first sub-frame period SF1.

During the second sub-frame period SF2, the first BDI gate timing control signal comprising the first gate start pulse GSPd and the first gate output enable signal GOEd as shown in FIG. 9B is applied to the second gate drive IC 732. Accordingly, the second gate drive IC 732 sequentially supplies the gate pulses having a pulse width by the substantially one horizontal period to the gate liens of the second block BL2 in response to the first gate start pulse GSPd and the first gate output enable signal GOEd. While the second block BL2 is being scanned, the source drive ICs alternately output the black gray voltage and the analog video data voltage in response to the BDI source output enable signal SOEb. Then, the gate pulses sequentially supplied to the gate lines of the second block BL2 are synchronized with the analog video data voltage outputted from the source drive ICs according to the first gate output enable signal GOEd. Accordingly, during the second sub-frame period SF2, the analog video data voltage is charged sequentially one line at a time in the second block BL2.

During the second sub-frame period SF2, the second BDI gate timing control signal includes the second gate start pulse GSPb and the second gate output enable signal GOEb as shown in FIG. 9*b* is applied to the third gate drive IC 733. Then, the third gate drive IC 733 sequentially supplies gate pulses having a pulse width by a substantially N number of horizontal periods to the gate lines of the third block BL3 in response to the second gate start pulse GSPb and the second gate output enable signal GOEb. Among the N number of gate pulses supplied to the Nth gate line in the third block BL3, the remaining (N−1) number of gate pulses excluding the first gate pulse overlap with the (N−1) number of gate pulses which are first supplied to the (N+1)th gate line. While the third block BL3 is being scanned, the source drive ICs alternately output the black gray voltage and the analog video data voltage in response to the source output enable signal SOEb. At this time, the gate pulses sequentially supplied to the gate lines of the third block BL3 are synchronized with the black gray voltage outputted from the source drive ICs according to the second gate output enable signal GOEb. Thus, during the second sub-frame period SF2, the N number of lines, except for the (N−2) number of lines to which the gate pulses are first supplied, are simultaneously scanned to simultaneously charge the black gray voltage to the N number of lines.

During the third sub-frame period SF3, the second BDI gate time control signal comprising the second gate start pulse GSPb, the second gate output enable signal GOEb, etc., as shown in FIG. 9*c* is applied to the first gate drive IC 731. Then, the first gate drive IC 731 sequentially supplies gate pulses having a pulse width by the substantially N number of horizontal periods to the gate lines in response to the second gate start pulse GSPb and the second gate output enable signal GOEb. In the first block BL1, among the N number of gate pulses supplied to the Nth gate line, the remaining (N−1) number of gate pulses excluding the first gate pulse overlap with the (N−1) number of gate pulses which are first supplied to the (N+1)th gate line. While the first block BL1 is being scanned, the source drive ICs alternately output the black gray voltage and the analog video data voltage in response to the source output enable signal SOEb. At this time, the gate pulses sequentially supplied to the gate lines of the first block BL1 are synchronized with the black gray voltage outputted from the source drive ICs according to the second gate output enable signal GOEb. Accordingly, during the third sub-frame period SF3, the N number of lines, excluding the (N−2) number of lines to which the gate pulses are first supplied, are simultaneously scanned to simultaneously charge the black gray voltage to the N number of lines in the first block BL1.

During the third sub-frame period SF3, the gate start pulse and the gate output enable signal are not applied to the second gate drive IC 732. Thus, during the third sub-frame period SF3, the liquid crystal cells of the second block BL2 maintain the analog data voltage which has been charged during the second sub-frame period SF2.

During the third sub-frame period SF3, the first BDI gate timing control signal comprising the first gate start pulse GSPd, the first gate output enable signal GOEd, etc., as shown in FIG. 9*c* is applied to the third gate drive IC 733. Then, the third gate drive IC 733 sequentially supplies gate pulses having a pulse width by the substantially one horizontal period to the gate lines of the third block BL3 in response to the first gate start pulse GSPd and the first gate output enable signal GOEd. While the third block BL3 is being scanned, the source drive ICs alternately output the black gray voltage and the analog video data voltage in response to the BDI source output enable signal SOEb. At this time, the gate pulses sequentially supplied to the gate lines of the third block BL3 are synchronized with the analog video data voltage outputted from the source drive ICs according to the first gate output enable signal GOEd. Accordingly, during the third sub-frame period SF3, the analog video data voltage is charged sequentially one line at a time in the third block BL3.

Figure 10:
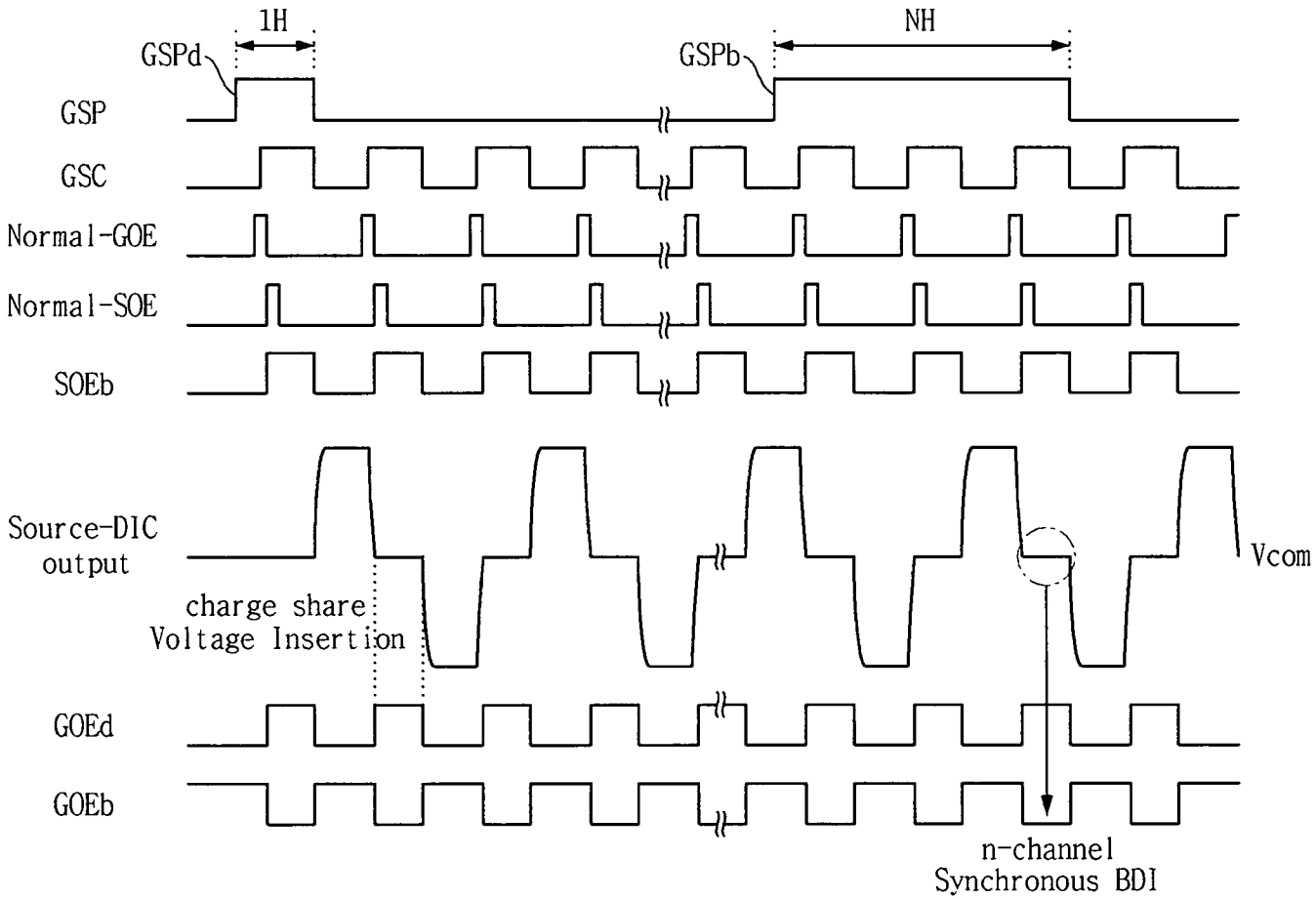
FIG. 10 is a waveform view showing timing control signals applied to source drive integrated circuits and gate drive integrated circuits when the LCD is driven according to the impulse driving method according to a first exemplary embodiment of the invention.

FIG. 10 is a waveform view showing timing control signals applied to the source drive ICs and the gate drive ICs when the LCD is driven according to the impulse driving method according to a first exemplary embodiment of the invention. With reference to FIG. 10, when the LCD according to the first exemplary embodiment of the invention is driven according to the impulse driving method, it uses the charge share voltage as the black gray voltage. This LCD is driven in the normally black mode.

In impulse-driving the liquid crystal panel 70, the timing controller 71 controls outputs of the source drive ICs by the BDI source output enable signal SOEb having a duty ratio larger than that of the normal source output enable signal (Normal-SOE). The respective source drive ICs alternately output the charge share voltage and the analog video data voltage in response to the BDI source output enable signal SOEb.

The timing controller 71 controls the gate drive ICs by using the first gate start pulse GSPd having a relatively small pulse width and the first gate output enable signal GOEd, the reversed phase of the second gate output enable signal GOEb. The gate drive ICs, which handle data display blocks to which the analog video data voltage is to be charged, sequentially output gate pulses in synchronization with the analog data voltage in response to the first gate output enable signal GOEd.

Also, the timing controller 71 controls the gate drive ICs by using the second gate start pulse GSPb having a relatively large pulse width and the second gate output enable signal GOEb, the reversed phase of the first gate output enable signal GOEd. The gate drive ICs, which handle the black display blocks to which the black gray voltage is to be charged, sequentially output gate pulses in synchronization with the charge share voltage in response to the second gate output enable signal GOEb.

As shown in FIG. 10, Normal-SOE is a normal source output enable signal applied for the liquid crystal panel in which data voltage is charged in a line-sequential manner without impulse driving, which has a duty ratio smaller than that of the BDI source output enable signal SOEb. Normal-GOE in FIG. 10 is a normal gate output enable signal applied for the liquid crystal panel in which data voltage is charged in a line-sequential manner without impulse-driving, which has a duty ratio smaller than those of the first and second gate output enable signals GOEd and GOEb.

Figure 11:
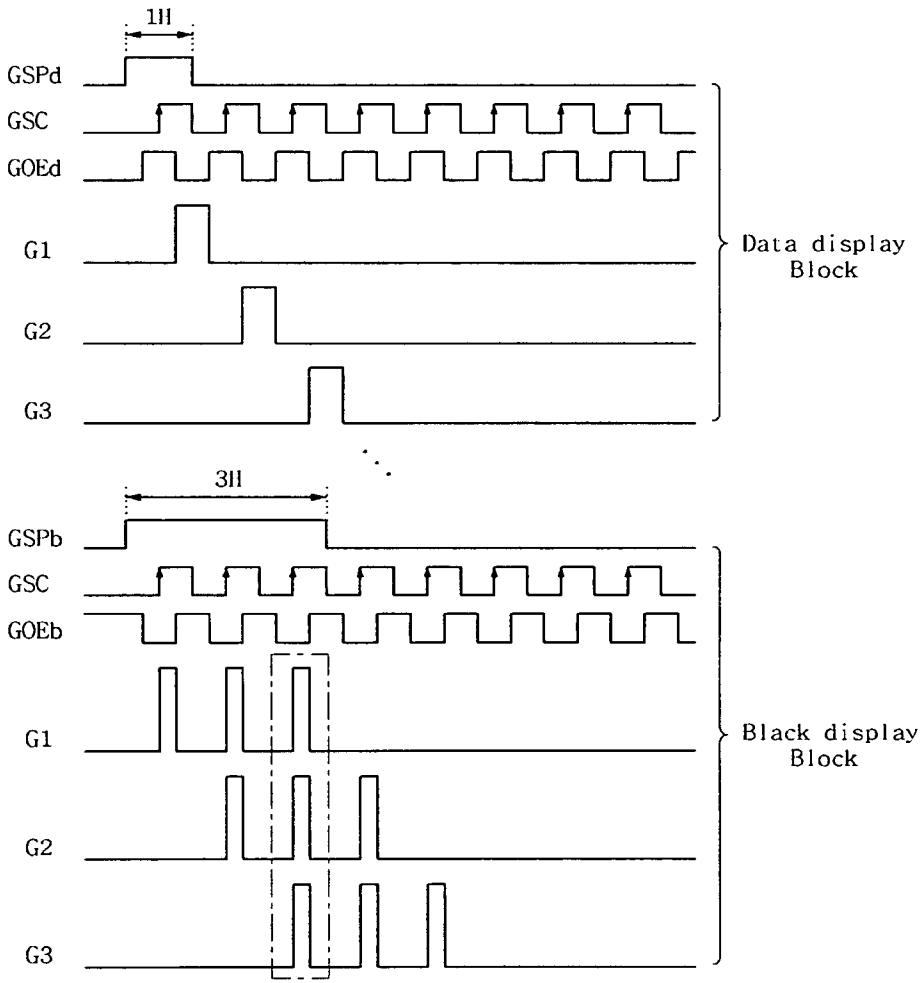
FIG. 11 is a waveform view showing the gate timing control signals and gate pulses shown in FIG. 10 by dividing gate drive ICs into the gate drive Integrated circuits handling data display blocks and the gate drive Integrated circuits handling black display blocks.

FIG. 11 is a waveform view showing the gate timing control signals and gate pulses shown in FIG. 10 by dividing gate drive ICs into the gate drive ICs handling the data display blocks and the gate drive ICs handling the black display blocks. With reference to FIG. 11, the shift registers of the gate drive ICs shift the gate start pulses GSPd and GSPb one stage at a time at every rising edge of the gate shift clock GSC, and output gate pulses during a low logical period of the gate output enable signals GOEd and GOEb. Accordingly, because the pulse width of the first gate start pulse GSPd is substantially one horizontal period and one cycle of the gate shift clock GSC is substantially one horizontal period, the gate drive ICs handling the data display blocks supply a gate pulse to a gate line, shift the gate pulse and supply the shifted gate pulse to the next gate line.

In comparison, the pulse width of the second gate start pulse GSPb is substantially the N number of horizontal periods, e.g., substantially three horizontal periods, and one cycle of the gate shift clock GSC is substantially one horizontal period, so the gate drive ICs handling the black display blocks supply the N number of pulses to a gate line, shift the gate pulses, and supply the shifted gate pulses to the next gate line. As a result, the gate pulses supplied to the N number of gate lines can be synchronized at the black display blocks indicated by a dotted line box. The liquid crystal cells included in the N number of lines scanned by the N number of gate lines simultaneously charge the charge share voltage to represent the black gray level.

In embodiments of the invention, as shown in FIGS. 10 and 11, the video data voltage corresponding to the data display blocks and the charge share voltage corresponding to the black display blocks are alternately charged to the corresponding blocks according to the source output enable signal SOEb and the gate output enable signals GOEd and GOEb applied by blocks.

Figure 12:
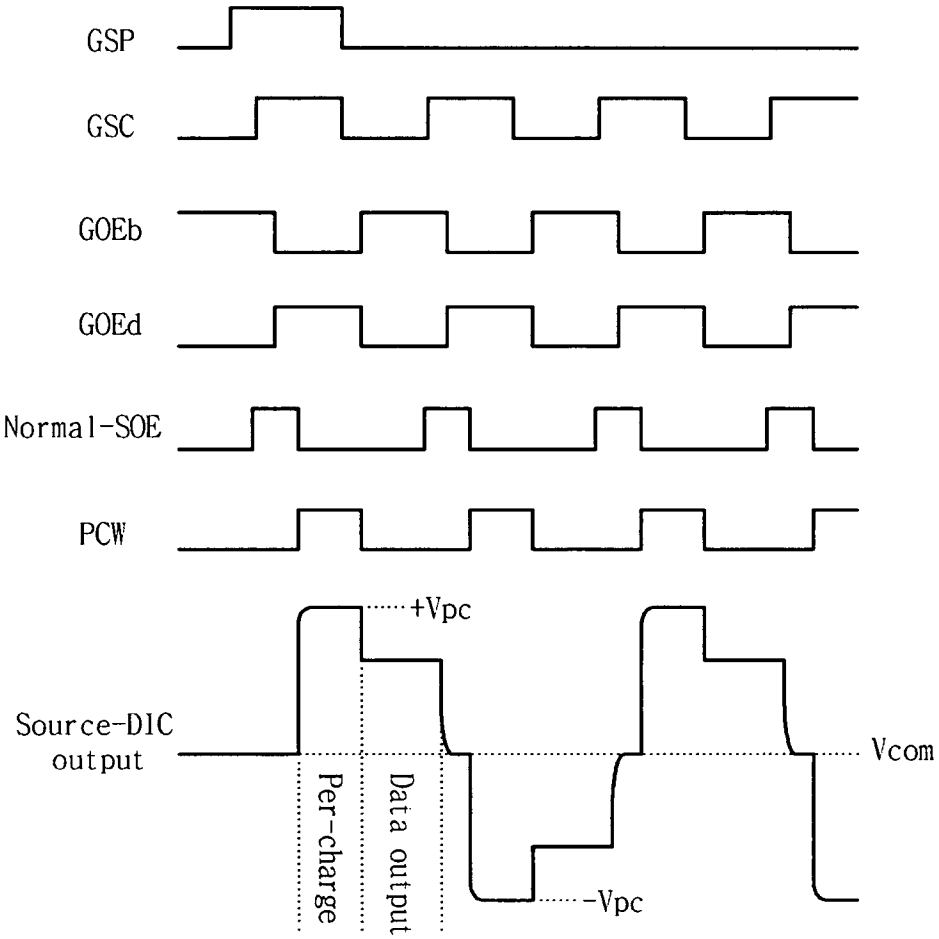
FIG. 12 is a waveform view showing timing control signals applied to the source drive Integrated circuits and the gate drive Integrated circuits when the LCD is driven according to the impulse driving method according to a second exemplary embodiment of the invention.

FIG. 12 is a waveform view showing timing control signals applied to the source drive ICs and the gate drive ICs when the LCD is driven according to the impulse driving method according to a second exemplary embodiment of the invention. With reference to FIG. 12, when the LCD according to the second exemplary embodiment is driven according to the impulse driving method, the precharge voltage (+Vpc/−Vpc) is used as the black gray voltage. This LCD is driven in the normally white mode.

When the liquid crystal panel 70 is driven according to the impulse driving method, the timing controller controls outputs of the source drive ICs by using the normal source output enable signal (Normal-SOE) having a relatively small duty ratio and the precharge control signal PCW having a large duty ratio compared with the normal precharge control signal. Preferably, the duty ratio of the precharge control signal PCW is about 40% to 60%. If the duty ratio of the precharge control signal PCW is smaller than 40%, the charge time of the black gray voltage would be shortened to reduce the black data insertion effect, namely, the impulse driving effect. If the duty ratio of the BDI source output enable signal SOEb exceeds 60%, the charge time of the analog data voltage would be excessively shortened to degrade gray scale representation of the data. The respective source drive ICs output the charge share voltage in response to the pulse of the normal source output enable signal Normal-SOE, and then output the positive polarity/negative polarity precharge voltage (+Vpc/−Vpc) in response to the pulse of the precharge control signal PCW. Subsequently, the respective source drive ICs output the analog video data voltage during the low logical period of the normal source output enable signal Normal-SOE.

The timing controller 71 controls the gate drive ICs by using the first gate start pulse GSPd and the first gate output enable signal GOEd. The gate drive ICs, which handle the data display blocks to which the analog video data voltage is to be charged, sequentially output the gate pulses in synchronization with the analog data voltage in response to the first gate output enable signal GOEd. Accordingly, the liquid crystal cells of the data display blocks can be charged with the analog video data voltage to display an image.

In addition, the timing controller 71 controls the gate drive ICs by using the second gate start pulse GSPb and the second gate output enable signal GOEb, the reversed phase of the first gate output enable signal GOEd. The gate drive ICs, which handle the black display blocks to which the black gray voltage is to be charged, sequentially output the gate pulses in synchronization with the positive polarity/negative polarity precharge voltage +Vpc/−Vpc in response to the second gate output enable signal GOEb. Accordingly, the liquid crystal cells of the black display blocks can be charged with the positive polarity/negative polarity precharge voltage +Vpc/−Vpc to represent black gray level.

Figure 13:
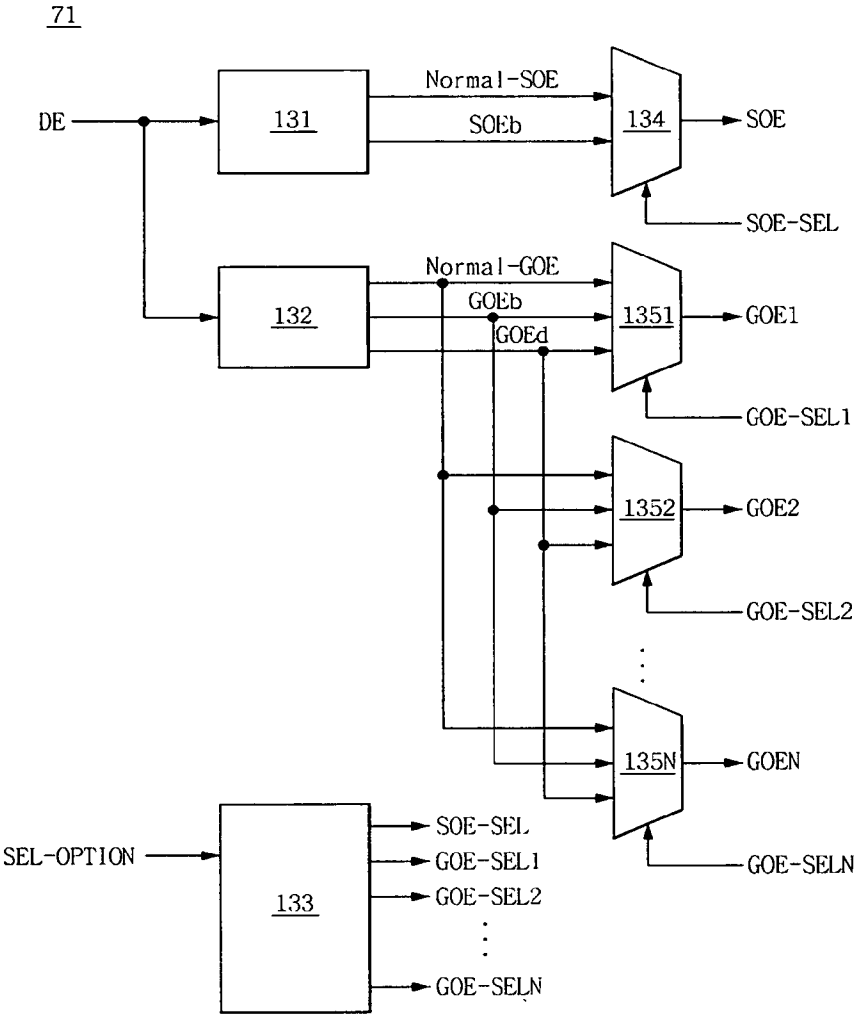
FIG. 13 is a circuit diagram showing circuit units for generating a source output enable signal and a gate output enable signal in a timing controller according to a first exemplary embodiment of the invention.

FIG. 13 is a circuit diagram showing circuit units for generating the source output enable signal and the gate output enable signal in the timing controller 71 according to a first exemplary embodiment of the invention. With reference to FIG. 13, the timing controller 71 includes an SOE generating unit 131, a GOE generating unit 132, an SEL generating unit 133, and a plurality of multiplexers 134 and 1351, 1352, . . . , 135N.

The SOE generating unit 131 generates the BDI source output enable signal SOEb and the general source output enable signal Normal-SOE, each having a different duty ratio, in response to the data enable signal DE.

The GOE generating unit 132 generates the normal gate output enable signal Normal-GOE having a small duty ratio in response to the data enable signal DE, and the first and second gate output enable signals GOEd and GOEb having a relatively high duty ratio and the mutually opposite phases.

The SEL generating unit 133 generates select signals SOE-SEL and GOE-SEL1 to GOE-SELN for controlling outputs of the multiplexers 134 and 1351 to 135N. The SEL generating unit 133 determines logical values of the select signals SOE-SEL and GOE-SEL1 to GOE-SELN for controlling the outputs of the multiplexers 134 and 1351 to 135N according to a voltage level from an external select terminal (SEL-OPTION pin) exposed from the timing controller 71. The external select terminal is selectively connected to one of a power voltage source Vcc and a base voltage source GND through a switch that can be manipulated by an operator. If the external select terminal is connected to the base voltage source GND, the SEL generating unit 133 may control the multiplexers 134 and 1351 to 135N so as to be suitable for the LCD normally operating without the impulse effect. If the external select terminal is connected to the power voltage source Vcc, the SEL generating unit 133 may control the multiplexers 134 and 1351 to 135N so as to be suitable for the LCD generating the impulse effect by charging the black gray voltage.

When the external select terminal is connected to the base voltage source GND, the SOE multiplexer 134 supplies the normal source output enable signal (Normal-SOE) having a small duty ratio to the source drive ICs in response to the select control signal SOE-SEL from the SEL selecting unit 133. If the external select terminal is connected to the power voltage source Vcc, the SOE multiplexer 134 supplies the BDI source output enable signal SOEb to the source drive ICs in response to the select control signal SOE-SEL from the SEL selecting unit 133.

The plurality of GOE multiplexers 1351 to 135N correspond to the gate drive ICs in a one-to-one manner. If the external select terminal is connected to the base voltage source GND, the GOE multiplexers 1351 to 135N supply the normal gate output enable signal (Normal-GOE) having a small duty ratio to the gate drive ICs in response to the select control signals GOE-SEL1 to GOE-SELN from the SEL selecting unit 133. If the external select terminal is connected to the power voltage source Vcc, the GOE multiplexers 1351 to 135N supply the first gate output enable signal GOEd or the second gate output enable signal GOEb, each having a high duty ratio, to the gate drive ICs in response to the select control signals GOE-SEL1 to GOE-SELN from the SEL selecting unit 133. The select control signals GOE-SEL1 to GOE-SELN may be 2-bit select signals.

Figure 14:
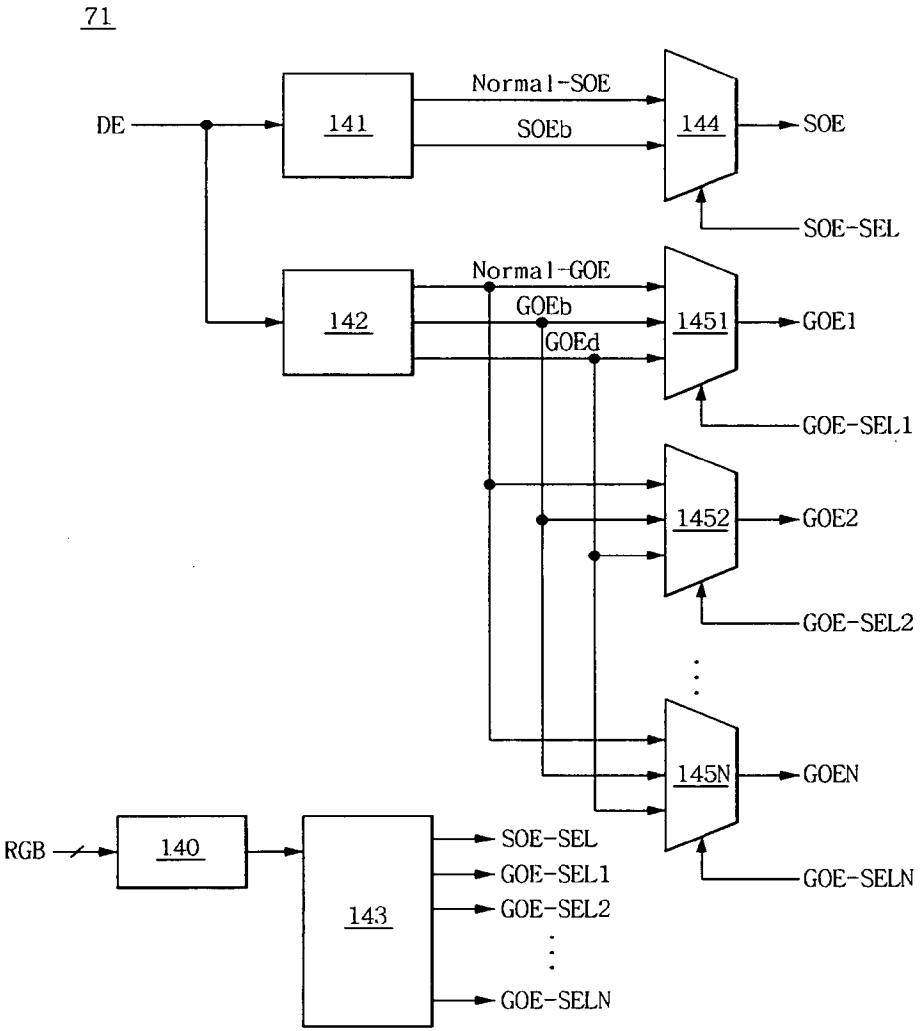
FIG. 14 is a circuit diagram showing circuit units for generating a source output enable signal and a gate output enable signal in a timing controller according to a second exemplary embodiment of the invention.

FIG. 14 is a circuit diagram showing circuit units for generating the source output enable signal and the gate output enable signal in the timing controller 71 according to a second exemplary embodiment of the invention. With reference to FIG. 14, the timing controller 71 includes an image determining unit 140, an SOE generating unit 141, a GOE generating unit 142, an SEL generating unit 143, and a plurality of multiplexers 144 and 1451 to 145N. The SOE generating unit 141 and the GOE generating unit 142 are substantially the same as those in FIG. 13, so a detailed description therefore will be omitted.

The image determining unit 140 determines whether or not video is inputted by using a known image determining method. The image determining unit 140 compares the input digital video data RGB by frames and pixels, and if the difference is smaller than a certain threshold value, the image determining unit 140 determines that the currently inputted image is a still image and controls the SEL generating unit 143 by using an image determining signal as '0'. If the difference is the certain threshold value or greater, the image determining unit determines that the currently inputted image as video (motion picture) and controls the SEL generating unit 143 by using the image determining signal as '1'.

The SEL generating unit 143 generates select signals SOE-SEL and GOE-SEL1 to GOE-SELN to control outputs of the multiplexers 144 and 1451 to 145N. The SEL generating unit 143 determines logical values of the select signals SOE-SEL and GOE-SEL1 to GOE-SELN to control the outputs of the multiplexers 144 and 1451 to 145N according to the image determining signal from the image determining unit 140. If the currently inputted image is a still image, the SEL generating unit 143 may control the multiplexers 144 and 1451 to 145N so as to be suitable for the LCD normally operating without the impulse effect. If the currently inputted image is video, the SEL generating unit 143 may control the multiplexers 144 and 1451 to 145N so as to be suitable for the LCD generating the impulse effect by charging the black gray voltage.

If the currently inputted image is a still image, the SOE multiplexer 144 supplies the normal source output enable signal Normal-SOE having a small duty ratio to the source drive ICs in response to the select control signal SOE-SEL from the SEL selecting unit 143. If the currently inputted image is video, the SOE multiplexer 134 supplies the BDI source output enable signal SOEb having a high duty ratio to the source drive ICs in response to the select control signal SOE-SEL from the SEL selecting unit 143.

The plurality of GOE multiplexers 1451 to 145N correspond to the gate drive ICs in a one-to-one manner. If a currently inputted image is a still image, the GOE multiplexers 1451 to 145N supply the normal gate output enable signal Normal-GOE having a small duty ratio to the corresponding gate drive ICs in response too the select control signals GOE-SEL1 to GOE-SELN from the SEL selecting unit 143. If the currently inputted image is video, the GOE multiplexers 1451 to 145N supply the first gate output enable signal GOEd or the second gate output enable signal GOEb having a high duty ratio to the corresponding gate drive ICs in response to the select control signals GOE-SEL1 to GOE-SELN from the SEL selecting unit 143. The select control signals GOE-SEL1 to GOE-SELN may be 2-bit select signals.

The description of the circuits in FIGS. 13 and 14 was focused on the first example of the black gray voltage, namely, the example of generating the timing control signals in FIGS. 10 and 11. The second example of the black gray voltage, namely, the timing control signals in FIG. 12, can be generated by using the circuits in FIGS. 13 and 14. For example, in embodiments of the invention, the SOE multiplexer 144 may be controlled to output the normal source output enable signal (Normal-SOE) having a small duty ratio regardless of the normal driving mode without the impulse effect or the impulse driving mode using the precharge voltage. In addition, in embodiments of the invention, a circuit for generating precharge control signals each having a different duty ratio and a circuit for selecting one of the precharge control signals may be added to the circuits in FIGS. 13 and 14 in order to differently control the duty ratio of the precharge control signals according to a driving mode.

Figure 15:
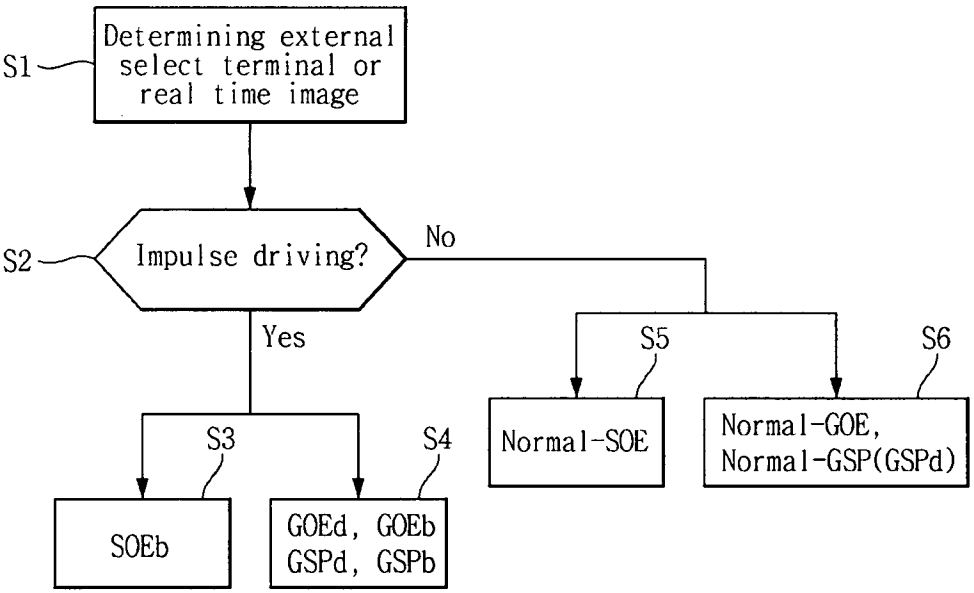
FIG. 15 is a flow chart illustrating the sequential processes of a method for driving an LCD according to a first exemplary embodiment of the invention.

FIG. 15 is a flow chart illustrating the sequential processes of a method for driving an LCD according to a first exemplary embodiment of the invention. With reference to FIG. 15, in the method for driving the LCD according to the first exemplary embodiment of the invention, a determination of whether or not the LCD is to be driven in the impulse driving mode according to determination of an external select terminal of the timing controller or a real time image (S1).

If the LCD is determined to be driven in the impulse driving mode according to the determination of the external select terminal or the real time image, the BDI source output enable signal SOEb having a high duty ratio compared with the normal source output enable signal (Normal-SOE) is generated, based on which outputs of the source drive ICs are controlled (S2, S3). In addition, when the LCD is determined to be driven in the impulse driving mode, the first and second gate output enable signals GOEd and GOEb having a high duty ratio compared with the normal gate output enable signal (Normal-GOE) and having the mutually opposite phases, based on which outputs of the gate drive ICs are controlled (S2, S4). Accordingly, in embodiments of the invention, in the LCD in the normally black mode and in the impulse driving mode, the charge share voltage is charged sequentially, N number of lines at a time, in each block to thus sufficiently charge the charge share voltage in the black display blocks.

In the method for driving the LCD according to the first exemplary embodiment of the invention, if the LCD is determined to be driven in the normal without the impulse driving effect according to the determination of the external select terminal or the real time image, the normal source output enable signal (Normal-SOE) having a small duty ratio is generated, based on which outputs of the source drive ICs are controlled (S2, S5). If the LCD is determined to be driven in the normal driving mode, the normal gate output enable signal (Normal-GOE) having a small duty ratio is generated, based on which outputs of the gate drive ICs are controlled (S2, S6).

Figure 16:
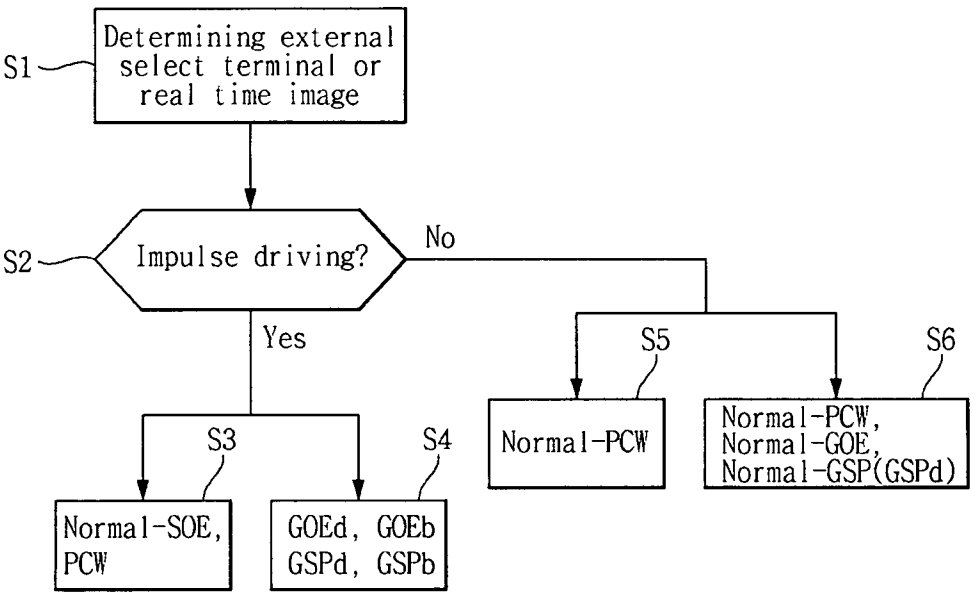
FIG. 16 is a flow chart illustrating the sequential processes of a method for driving an LCD according to a second exemplary embodiment of the invention.

FIG. 16 is a flow chart illustrating the sequential processes of a method for driving an LCD according to a second exemplary embodiment of the invention. With reference to FIG. 16, in the method for driving the LCD according to the second exemplary embodiment of the invention, whether or not the LCD is to be driven in the impulse driving mode according to determination of an external select terminal of the timing controller or a real time image (S1).

If the LCD is determined to be driven in the impulse driving mode according to the determination of the external select terminal or the real time image, the BDI precharge control signal PCW having a high duty ratio compared with the normal precharge control signal (Normal-PCW) is generated, based on which the outputs of the positive polarity/negative polarity precharge voltages (+Vpc/−Vpc) outputted from the source drive ICs are controlled (S2, S3). Here, the duty ratio of the precharge control signal PCW in the impulse driving mode is about 40% to 60% as mentioned above. In addition, when the LCD is determined to be driven in the impulse driving mode, the first and second gate output enable signals GOEd and GOEb having a high duty ratio compared with the normal gate output enable signal (Normal-GOE) and having the mutually opposite phases, based on which outputs of the gate drive ICs are controlled (S2, S4). Accordingly, in embodiments of the invention, in the LCD in the normally white mode and in the impulse driving mode, the positive polarity/negative polarity precharge voltage is charged sequentially, N number of lines at a time, in each block to thus sufficiently charge the positive polarity/negative polarity precharge voltage in the black display blocks.

If the LCD is determined to be driven in the normal driving mode without the impulse driving effect according to the determination of the external select terminal or the real time image, the normal precharge control signal (Normal-PCW) having a small duty ratio of 10% or some is generated, based on which the outputs of the positive polarity/negative polarity precharge voltages (+Vpc/−Vpc) outputted from the source drive ICs are controlled (S2, S5). In addition, if the LCD is determined to be driven in the normal driving mode, the normal gate output enable signal (Normal-GOE) having a small duty ratio is generated, based on which outputs of the gate drive ICs are controlled (S2, S6).

Therefore, in the LCD and its driving method according to the embodiments of the invention, the impulse driving mode and the normal driving mode can be selected by selecting the timing control signal, and the motion blurring phenomenon in video (motion picture) can be prevented by increasing the charge amount of the charge share voltage or the precharge voltage in the black display blocks. In addition, by increasing the duty ratio of the timing control signal, there is no need to increase the data transmission frequency between the timing controller and the data driving circuit. Thus, the data transmission frequency conversion circuit including a memory, a PLL, etc., can be omitted in the timing controller, and thus, the circuit costs as much can be reduced.

What is claimed is:

1. A liquid crystal display, comprising:

a liquid crystal panel comprising liquid crystal cells in a matrix array at crossings of data lines and gate lines, where a screen of the liquid crystal panel is divided into two blocks, on which one block is controlled as a data write block and another block is controlled as a black insertion block to be driven by an impulsive driving method;

a timing controller for receiving a digital video data and synchronous signals, and generating a source output enable signal, a first gate start pulse, a second gate start pulse comprising a pulse width different from that of the first gate start pulse, a gate shift clock, a first gate output enable signal, and a second gate output enable signal;

a data driving circuit for providing a data voltage to the data lines in response to a first logic value of the source output enable signal, and any one black gray voltage of a charge share voltage to the data lines in response to a second logic value of the source output enable signal or precharge voltage to the data lines in response to the first logic value of the source output enable signal, the data voltage being supplied to the data write block, the any one black gray voltage being supplied to the black insertion block; and a gate driving circuit for providing a first gate pulse in synchronization with the data voltage and in response to the first gate start pulse, the gate shift clock, and the first gate output enable signal and for providing a second gate pulse in synchronization with the black gray voltage to the gate lines, the second gate start pulse, the gate shift clock, and the second gate output enable signal, wherein the timing controller includes:

an image determining unit determining whether the digital video data is a motion picture or not, a selection signal generator generating a first selection signal and a second selection signal in response to a determining result of the image determining unit, a first multiplexer selecting any one of a normal source output enable signal and the source output enable signal, and supplying a selected source output enable signal to the data driving circuit, and a second multiplexer selecting any one of a normal gate output enable signal, the first gate output enable signal, and the second gate output enable signal, and supplying a selected gate output enable signal to the gate driving circuit, wherein a duty ratio of the normal source output enable signal is smaller than that of the source output enable signal, and wherein a duty ratio of the normal gate output enable signal is smaller than that of the first and second gate output enable signal.

2. The liquid crystal display according to claim 1, wherein each of the source output enable signal, the gate output enable signal, and the reversed gate output enable signal has a duty ratio of 40% to 60%.

3. The liquid crystal display according to claim 2, wherein the second gate start pulse has a pulse width larger than that of the first gate start pulse.

4. The liquid crystal display according to claim 1, wherein a phase of the second gate output enable signal is reversed to that of the first gate output enable signal.

5. The liquid crystal display according to claim 1, wherein the charge share voltage is one of a common voltage to be applied to a common electrode of the liquid crystal panel, and an average voltage between positive and negative voltages of adjacent data lines.

6. The liquid crystal display according to claim 5, wherein:

the precharge voltage includes a positive precharge voltage and a negative precharge voltage;

the positive precharge voltage is a maximum positive polarity data voltage or a positive polarity voltage between the maximum positive polarity data voltage and the charge share voltage; and the negative precharge voltage is a maximum negative polarity data voltage or a negative polarity voltage between the maximum negative polarity data voltage and the charge share voltage.

7. The liquid crystal display according to claim 1, wherein:

the first multiplexer selects the source output enable signal when the digital video data is a motion picture; and the second multiplexer selects any one of the first gate output enable signal and the second gate output enable signal when the digital video data is a motion picture.

8. The liquid crystal display according to claim 3, wherein the gate driving circuit:

outputs the first gate pulse in response to the first gate start pulse, the gate shift clock, and the first gate output enable signal; and outputs the second gate pulse in response to the second gate start pulse, the gate shift clock, and the second gate output enable signal.

9. The liquid crystal display according to claim 8, wherein:

the gate driving circuit supplies simultaneously the second gate pulse to the N gate lines; and N is an integer of 2 or greater.

10. A method of driving a liquid crystal display comprising a liquid crystal panel comprising liquid crystal cells in a matrix array at crossings of data lines and gate lines, a data driving circuit for driving the data lines, and a gate driving circuit for driving the gate lines, a screen of the liquid crystal panel being divided into two blocks, on which one block is controlled as a data write block and another block is controlled as a black insertion block to be driven by an impulsive driving method, the method comprising:

determining whether a input digital video data is a motion picture or not;

generating a first selection signal and a second selection signal in response to a determining result of the image determining unit;

selecting any one of a normal source output enable signal and a source output enable signal;

supplying a selected source output enable signal to a data driving circuit, a duty ratio of the normal source output enable signal being smaller than that of the source output enable signal;

selecting any one of a normal gate output enable signal, a first gate output enable signal, and a second gate output enable signal comprising a pulse width different from that of the first gate start pulse;

supplying a selected gate output enable signal to a gate driving circuit, a duty ratio of the normal gate output enable signal being smaller than that of the first and second gate output enable signal;

generating a gate shift clock providing a data voltage to the data lines in response to a first logic value of the source output enable signal, and any one black gray voltage of a charge share voltage to the data lines in response to a second logic value of the source output enable signal or precharge voltage to the data lines in response to the first logic value of the source output enable signal, the data voltage being supplied to the data write block, the any one black gray voltage being supplied to the black insertion block; and providing a first gate pulse in synchronization with the data voltage and in response to the first gate start pulse, the gate shift clock, and the first gate output enable signal and for providing a second gate pulse in synchronization with the black gray voltage to the gate lines, the second gate start pulse, the gate shift clock, and the second gate output enable signal.

11. The method according to claim 10, wherein each of the source output enable signal, the gate output enable signal, and the reversed gate output enable signal has a duty ratio of 40% to 60%.

12. The method according to claim 11, wherein the second gate start pulse has a pulse width larger than that of the first gate start pulse.

13. The method according to claim 10, wherein a phase of the second gate output enable signal is reversed to that of the first gate output enable signal.

14. The method according to claim 10, wherein the charge share voltage is one of a common voltage to be applied to a common electrode of the liquid crystal panel, and an average voltage between positive and negative voltages of adjacent data lines.

15. The method according to claim 14, wherein:

the precharge voltage includes a positive precharge voltage and a negative precharge voltage;

the positive precharge voltage is a maximum positive polarity data voltage or a positive polarity voltage between the maximum positive polarity data voltage and the charge share voltage; and the negative precharge voltage is a maximum negative polarity data voltage or a negative polarity voltage between the maximum negative polarity data voltage and the charge share voltage.

16. The method according to claim 10, wherein:

the source output enable signal is selected when the digital video data is a motion picture; and any one of the first gate output enable signal and the second gate output enable signal is selected when the digital video data is a motion picture.

17. The method according to claim 12, wherein the gate driving circuit:

outputs the first gate pulse in response to the first gate start pulse, the gate shift clock, and the first gate output enable signal; and outputs the second gate pulse in response to the second gate start pulse, the gate shift clock, and the second gate output enable signal.

18. The method according to claim 8, wherein:

the gate driving circuit supplies simultaneously the second gate pulse to the N gate lines; and wherein N is an integer of 2 or greater.

19. A liquid crystal display, comprising:

a liquid crystal panel comprising liquid crystal cells in a matrix array at crossings of data lines and gate lines, where a screen of the liquid crystal panel is divided into two blocks, on which one block is controlled as a data write block and another block is controlled as a black insertion block to be driven by an impulsive driving method;

a timing controller for receiving a digital video data and synchronous signals, and generating a source output enable signal, a first gate start pulse, a second gate start pulse comprising a pulse width different from that of the first gate start pulse, a gate shift clock, a first gate output enable signal, and a second gate output enable signal;

a data driving circuit for providing a data voltage to the data lines in response to a first logic value of the source output enable signal, and any one black gray voltage of a charge share voltage to the data lines in response to a second logic value of the source output enable signal or precharge voltage to the data lines in response to the first logic value of the source output enable signal, the data voltage being supplied to the data write block, the any one black gray voltage being supplied to the black insertion block; and a gate driving circuit for providing a first gate pulse in synchronization with the data voltage and in response to the first gate start pulse, the gate shift clock, and the first gate output enable signal and for providing a second gate pulse in synchronization with the black gray voltage to the gate lines, the second gate start pulse, the gate shift clock, and the second gate output enable signal, wherein:

the second gate start pulse has a width N times of the gate shift clock, where N is a integer equal to or over 2; and the gate driving circuit:

supplies the N number of gate pulses to (m)-th gate line of the black insertion block, synchronized with the low logical period of the second gate output enable signal; and supplies gate pulses to (m+1)-th gate line of the black insertion block so that the gate pulses are overlapped with N−1 number of the N number of gate pulses, where m is a positive integer.

20. A liquid crystal display, comprising:

a liquid crystal panel comprising liquid crystal cells in a matrix array at crossings of data lines and gate lines, where a screen of the liquid crystal panel is divided into two blocks, on which one block is controlled as a data write block and another block is controlled as a black insertion block to be driven by an impulsive driving method;

a timing controller for receiving a digital video data and synchronous signals, and generating a source output enable signal, a first gate start pulse, a second gate start pulse comprising a pulse width different from that of the first gate start pulse, a gate shift clock, a first gate output enable signal, and a second gate output enable signal;

a data driving circuit for providing a data voltage to the data lines in response to a first logic value of the source output enable signal, and any one black gray voltage of a charge share voltage to the data lines in response to a second logic value of the source output enable signal or pre-charge voltage to the data lines in response to the first logic value of the source output enable signal, the data voltage being supplied to the data write block, the any one black gray voltage being supplied to the black insertion block; and a gate driving circuit for providing a first gate pulse in synchronization with the data voltage and in response to the first gate start pulse, the gate shift clock, and the first gate output enable signal and for providing a second gate pulse in synchronization with the black gray voltage to the gate lines, the second gate start pulse, the gate shift clock, and the second gate output enable signal;

supplying the N number of gate pulses to (m)-th gate line of the black insertion block, synchronized with the low logical period of the second gate output enable signal; and supplying gate pulses to (m+1)-th gate line of the black insertion block such that the gate pulses are overlapped with N−1 number of the N number of gate pulses, wherein m is a positive integer, wherein the second gate start pulse has a width N times of the gate shift clock, and wherein N is a integer equal to or over 2.

* * * * *